US006294869B1

(12) United States Patent
Adachi et al.

(10) Patent No.: US 6,294,869 B1
(45) Date of Patent: Sep. 25, 2001

(54) HIGH INTENSITY LIGHT IRRADIATION APPARATUS

(75) Inventors: Nobuo Adachi; Yasuhiko Okugi, both of Chofu (JP)

(73) Assignee: ORC Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/482,443

(22) Filed: Jan. 11, 2000

(30) Foreign Application Priority Data

Feb. 1, 1999 (JP) ..... 11-023356

(51) Int. Cl.[7] ..... H01J 65/00

(52) U.S. Cl. ..... 313/607; 313/35; 313/46; 313/234; 313/292; 313/238; 313/594

(58) Field of Search ..... 313/25, 22, 24, 313/36, 46, 607, 594, 234, 292, 239

(56) References Cited

U.S. PATENT DOCUMENTS 5,432,398 * 7/1995 Kogelschatz ..... 313/607 X
5,757,132 * 5/1998 Matsuno et al. ..... 313/234 X
5,929,564 * 7/1999 Nakaya et al. ..... 313/607

FOREIGN PATENT DOCUMENTS 6-338302 * 6/1994 (JP) ..... 313/234

* cited by examiner

*Primary Examiner*—Ashok Patel
(74) *Attorney, Agent, or Firm*—Dellett and Walters

(57) ABSTRACT

The present invention is designed to provide a high intensity light irradiation apparatus having a simpler, lighter, easy to assemble and replace support member for a dielectric barrier electrical discharge lamp. The dielectric barrier electrical discharge lamp 1 comprises concentric outer tube 11 and inner tube 12 to form an inert gas filled electrical discharge space 14 defined by the outer and inner tubes 11,12 and their end walls. A metal rod 3 is inserted into the inner tube 12 of the electrical discharge lamp 1. A pair of clamp members 4 are secured to both ends of the metal rod 3 for clamping the both ends of the electrical discharge lamp 1. An AC voltage is applied between the metal rod 3 and an outer electrode 21 on the surface of the outer tube 11. Cooling water flows through the gap between the metal rod 3 and the inner tube 12.

16 Claims, 2 Drawing Sheets

HIGH INTENSITY LIGHT IRRADIATION APPARATUS

BACKGROUND OF THE INVENTION

The present invention relates generally to a high intensity light irradiation apparatus using a dielectric barrier electrical discharge lamp for emitting high power of ultraviolet, more specifically to a simpler, lighter, and easy to assemble and replace support member for such high intensity light irradiation apparatus.

Dielectric barrier electrical discharge lamps find wide applications including curing ultraviolet curing resin in fabrication of semiconductor devices and liquid crystal display devices, purifying exhausted gases, and ultraviolet light sources for synthesizing chemical compounds.

A cross section view of a conventional high intensity light irradiation apparatus is illustrated in FIG. 3 and such conventional high intensity light irradiation apparatus comprises a ultraviolet transparent dielectric outer tube 11 and a dielectric inner tube 12 made from quartz glass or sapphire disposed concentrically with each other, a dielectric barrier electrical discharge lamp 1 having an electrical discharge space 14 filled with inert (or rare) gas such as argon, krypton, xenon, etc. Further comprising are a light transparent outer electrode 21 (e.g., mesh electrode, NESA coat, etc.) disposed on the surface of the dielectric outer tube 11, an inner electrode 22 disposed in a spiral manner on the surface of the dielectric inner tube 12 and an AC power source (not shown) for applying AC voltage between the outer electrode 21 and the inner electrode 22. High intensity ultraviolet is generated by plasma discharge in the electrical discharge space 14 by way of the layers of the dielectric tubes 11,12.

In such conventional high intensity light irradiation apparatus using dielectric barrier electrical discharge lamp 1 requires circulation of cooling water in the dielectric tube 12 for cooling the electrical discharge lamp 1. In addition to the cooling means, the electrical discharge lamp 1 requires a support member 9 for supporting the electrical discharge lamp 1 including the light transparent outer electrode 21 and the inner electrode 22.

Such support member 9 comprises an elongate rod member 91 longer than the electrical discharge lamp 1 to be supported, a pair of protrusions 92 raising from the both ends of the rod member 91 and each having a threaded hole 93 in parallel with the rod member 91, bushing members 94 screwed in the respective threaded holes 93, and sliding members 95 inserted into center holes of the bushing members 94 each provided with a flange 97 and an extending hole 96 for passing the cooling water therethrough.

For supporting the electrical discharge lamp 1 by the support member 9, the bushing members 94 are screwed from outside of the both protrusion members 94 to their half way and the sliding members 95 are slid into the center holes of respective bushing members 94. Both ends of the electrical discharge lamp 1 are clamped by the sliding members 95 by way of sealing gaskets 5 disposed in the respective flanges 97 of the both sliding members 95. Further screwing the bushing members 94 toward to each other, the sliding members 95 are pushed inwardly at their flanges 97, thereby reducing the distance between opposed sliding members 95 to apply desired clamping pressure onto the electrical discharge lamp 1. Finally, hoses for circulating the cooling water through the extending holes 96 are coupled to the inlet/outlet couplers 98 of the sliding members 95 and an AC power is connected between the outer electrode 21 and the inner electrode 22 of the electrical discharge lamp 1.

Now, the support member 9 for supporting the electrical discharge lamp 1 tends to become large and heavy because the support member 9 must provide sufficient mechanical strength so that the electrical discharge lamp 1 does not deform in operation.

When installing such electrical discharge lamp 1 supported by the large and heavy support member 9 onto an application machine, there are some restrictions in the design freedom of such application machine due to not only the size and weight but also replacement of the electrical discharge lamp 1 at the end of its lifetime. Accordingly, there is a strong need for providing a high intensity light irradiation apparatus using a simpler, lighter and easy to assemble and replace support member.

SUMMARY OF THE INVENTION

In accordance with the present invention, the high intensity light irradiation apparatus utilizes a simpler, lighter support member and features ease in assembling and replacing the electrical discharge lamp.

The high intensity light irradiation apparatus includes a dielectric barrier electrical discharge lamp 1 having an electrical discharge space 14 filled with an inert gas and surrounded by concentrically disposed light transparent dielectric outer tube 11, a dielectric inner tube 12 and end walls 13 at the both ends; a light transparent outer electrode 21 disposed on the surface of the light transparent dielectric outer tube 11 and an inner electrode 22 disposed on the surface of the dielectric outer tube 12; and an AC power source for applying an AC voltage between the outer electrode 21 and the inner electrode 22. The high intensity light irradiation apparatus features in further comprising a metal rod 3 having a smaller diameter than the inner diameter of the dielectric inner tube 12 and to be inserted into the dielectric inner tube 12 of the dielectric barrier electrical discharge lamp 1, and clamp members 4 for sealing both end portions of the dielectric barrier discharge lamp 1 and each having a hole through which the metal rod 3 passes, where in the metal rod 3 holds the clamp members 4 that clamps the dielectric barrier electrical discharge lamp at the both ends.

DETAILED DESCRIPTION

Figure 1:
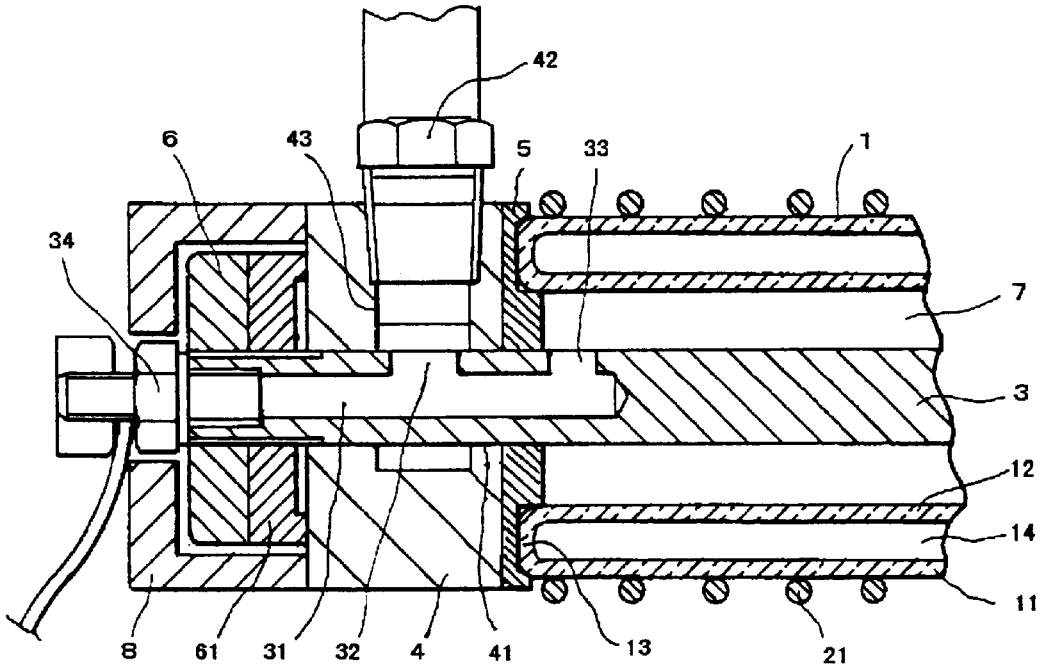
FIG. 1 is a cross section view of one end of a first embodiment of the high intensity light irradiation apparatus according to the present invention.

As one end portion is shown in FIG. 1 in cross section view, the high intensity light irradiation apparatus according to the present invention comprises a dielectric barrier electrical discharge lamp 1 having an electrical discharge space 14 filled with an inert gas (e.g., algon, kripton, xenon, etc.) and surrounded by a concentrically disposed ultraviolet transparent dielectric outer tube 11 made from quartz glass, etc., a dielectric inner tube 12 and end walls 13 at the both ends, a light transparent outer electrode 21 such as a mesh electrode, NESA coat etc. disposed on the surface of the dielectric outer tube 11, an inner electrode 22 disposed on the surface of the dielectric inner tube 12, an AC power source (not shown) for applying an AC voltage between the outer electrode 21 and the inner electrode 22, and a support member for the electrical discharge lamp.

(First Embodiment)

The support member for supporting the electrical discharge lamp 1 comprises a metal rod 3 inserted into the dielectric inner tube 12 of the electrical discharge lamp 1 and having an outer diameter smaller than the inner diameter of the dielectric inner tube 12 and also acting as an inner electrode, and clamp members 4 each having an extending hole into which the metal rod 3 is inserted for clamping the both end portions of the electrical discharge lamp 1 one end portion of which is illustrated in FIG. 1 in a cross section view.

The metal rod 3 is threaded at each end for screw coupling a nut 6 and is formed with a hole 31 extending partly along the axis, and holes 32,33 in communication with the axial hole 31 bored radially with a given spacing therebetween and a bolt 34 for closing the end of the axial hole 31.

Each of the clamp members 4 comprises a hole 41 for receiving the respective end of the metal rod 3, and an opening 43 open in the radial direction for insertion of an inlet/outlet coupler 42 through which the cooling water passes. Also provided is an insulation cap 8 for protecting each end of the clamp members 4.

Now, described is an assembling process of the electrical discharge lamp 1 with the support member comprising the metal rod 3 and the clamp members 4. Firstly, the metal rod 3 is inserted into the dielectric inner tube 12 of the electrical discharge lamp 1. The clamp members 4 are then coupled to the respective ends of the metal rod 3 by way of sealing gaskets 5 at the both ends of the electrical discharge lamp 1. Subsequently, the nuts 6 are screwed in the threaded holes 31 of the metal rod 3 by way of washers 61 for clamping the both ends of the electrical discharge lamp 1. Finally, hoses are coupled to the both couplers 42 and an AC power source is connected between the outer electrode 21 of the electrical discharge lamp 1 and the metal rod 3 to complete the assembly.

The cooling water flows from one of the couplers 42 into the hole 32 in the metal rod 3 and passes through the axial hole 31 into the space 7 between the metal rod 3 and the dielectric inner tube 12. The electrical discharge lamp 1 is cooled while the cooling water flows inside the dielectric inner tube 12. The cooling water passes through the hole 33, the axial hole 31, the hole 32 at the opposite end of the metal rod 3 and exits from the other coupler 42.

Figure 3:
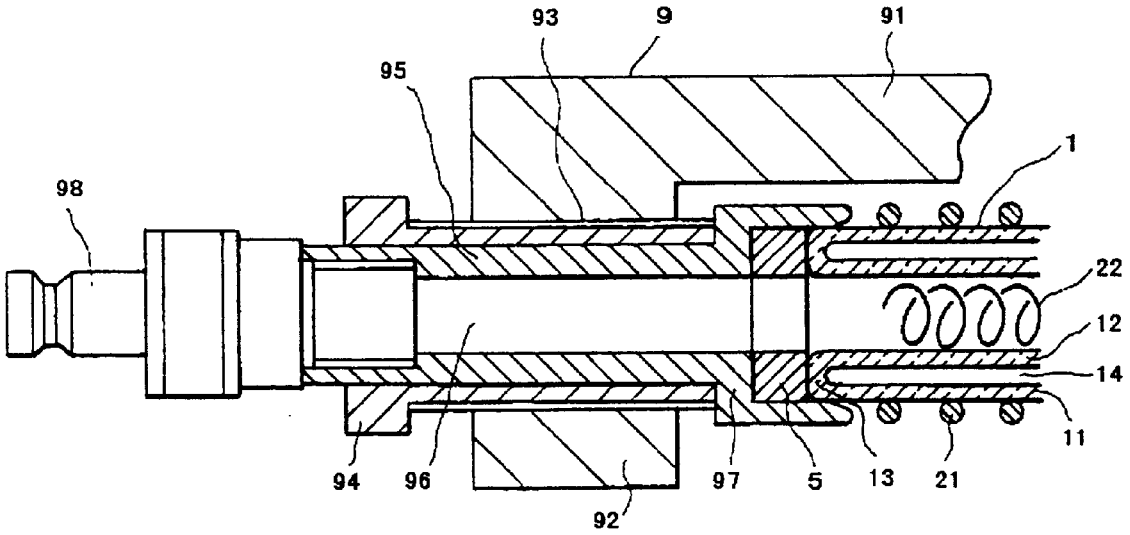
FIG. 3 is a cross section view of one end of a conventional dielectric barrier electrical discharge lamp supported by a support member.

The metal rod 3 inserted into the dielectric inner tube 12 reduces the cross section area of the space 7, thereby increasing the flow rate of the cooling water and improving the cooling efficiency. It is to be noted here that the electrically conductive metal rod 3 can replace the inner electrode on the surface of the dielectric inner tube 12 of the electrical discharge lamp 1 which is required in the conventional electrical discharge lamp as shown in FIG. 3.

(Second Embodiment)

Figure 2:
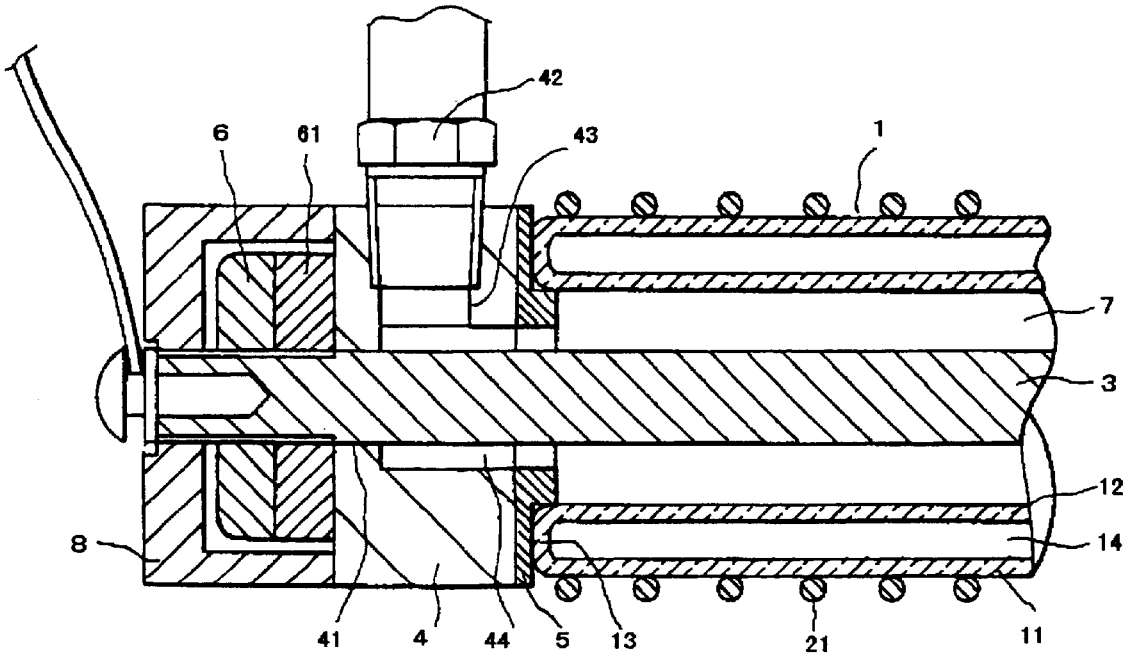
FIG. 2 is a cross section view of one end of a second embodiment of the high intensity light irradiation apparatus according to the present invention.

The support member for supporting the electrical discharge lamp 1 according to a second embodiment of the present invention is partly (only one end portion thereof) illustrated in FIG. 2. The support member comprises a metal rod 3 having an outer diameter smaller than the inner diameter of the dielectric inner tube 12 to enable insertion into the dielectric inner tuber 12 of the electrical discharge tube 12 and clamp members 4 for clamping both end portions of the electrical discharge lamp 1.

The metal rod 3 also acting as an inner electrode is provided with screws at both ends for coupling nuts 6. Each of the clamp members 4 is formed with a through-hole 41 into which the metal rod 3 is inserted, a hole 43 open in the radial direction for insertion of an inlet/outlet coupler 42 and a concentric opening 44 having a larger diameter than the outer diameter of the metal rod 3.

In assembling, the metal rod 3 is inserted into the electrical discharge lamp 1, the clamp members 4 are mated with the respective ends of the metal rod 3 by way of sealing gaskets 5 at both ends of the electrical discharge lamp 1, and then the clamp members 4 are secured to both ends of the electrical discharge lamp 1. The clamp members 4 are then secured to both ends of the electrical discharge lamp 1 by fastening the nuts 6 to the metal rod 3 by way of washers 61. Subsequently, hoses for circulating the cooling water are coupled to the both couplers 42 and an AC power source is connected between the outer electrode 21 of the electrical discharge lamp 1 and the metal rod 3 to complete the assembling.

The cooling water flows from one of the couplers 42 through the opening 44 between the metal rod 3 and the clamp member 4 and the space 7 to cool the dielectric inner tube 12 before being exhausted through the opening 44 between the metal rod 3 and the other clamp member 4 and the other coupler 42 at the opposite end of the metal rod 3.

It is to be noted that the metal rod 3 in the dielectric inner tube 12 substantially reduces the cross section area of the space 7 between the dielectric inner tube 12 and the metal rod 3, thereby increasing the flow rate of the cooling water and improving cooling efficiency.

As apparent from the above description, the high intensity light irradiation apparatus according to the present invention requires less component count in the support member for supporting and cooling the dielectric barrier electrical discharge lamp. The support member is simpler and lighter than the conventional design and yet very simple in assembling and replacing.

It is to be noted that the present invention is not limited to the above embodiment. A person skilled in the art can make various modifications without departing from the scope of the present invention.

What is claimed is:

1. A high intensity light irradiation apparatus including a dielectric barrier electrical discharge lamp having concentrically disposed outer tube and inner tube to form an electrical discharge space defined by the outer and inner tubes and both end walls at both ends of the outer and inner tubes to be filled with an inert gas, characterized in the support member comprising:

a metal rod having an outer diameter smaller than the inner diameter of the inner tube, the metal rod being inserted into the inner tube; and a pair of clamp members having through-holes for receiving the metal rod and for clamping the dielectric barrier electrical discharge tube at the both ends;

wherein an AC voltage is applied between the metal rod and electrode on the surface of the outer tube.

2. A high intensity light irradiation apparatus of claim 1, wherein cooling water is allowed to flow in the space between the metal rod and the inner tube.

3. A high intensity light irradiation apparatus of claim 2, wherein inlet/outlet couplers are formed in the clamp members in communication with the space between the metal rod and the inner tube.

4. A high intensity light irradiation apparatus of claim 2, wherein axial and radial holes are formed at each end portion of the metal rod to provide a path for the cooling water.

5. A high intensity light irradiation apparatus of claim 2, wherein each of the clamp members is formed with a radial hole and a concentric hole having a larger diameter than the axial hole for receiving the respective end of the metal rod.

6. A high intensity light irradiation apparatus of claim 1, wherein sealing gaskets are disposed between the respective clamp members and the ends of the electrical discharge lamp.

7. A high intensity light irradiation apparatus of claim 1, wherein the clamp members are secured to the respective ends of the metal rod by nuts.

8. A high intensity light irradiation apparatus of claim 1, wherein the clamp members are covered with insulating caps.

9. A high intensity light irradiation apparatus of claim 3, wherein axial and radial holes are formed at each end portion of the metal rod to provide a path for the cooling water.

10. A high intensity light irradiation apparatus of claim 3, wherein each of the clamp members is formed with a radial hole and a concentric hole having a larger diameter than the axial hole for receiving the respective end of the metal rod.

11. A high intensity light irradiation apparatus of claim 2, wherein sealing gaskets are disposed between the respective clamp members and the ends of the electrical discharge lamp.

12. A high intensity light irradiation apparatus of claim 3, wherein sealing gaskets are disposed between the respective clamp members and the ends of the electrical discharge lamp.

13. A high intensity light irradiation apparatus of claim 4, wherein sealing gaskets are disposed between the respective clamp members and the ends of the electrical discharge lamp.

14. A high intensity light irradiation apparatus of claim 5, wherein sealing gaskets are disposed between the respective clamp members and the ends of the electrical discharge lamp.

15. A high intensity light irradiation apparatus of claim 9, wherein sealing gaskets are disposed between the respective clamp members and the ends of the electrical discharge lamp.

16. A high intensity light irradiation apparatus of claim 10, wherein sealing gaskets are disposed between the respective clamp members and the ends of the electrical discharge lamp.

* * * * *